US007927142B2

(12) United States Patent
Wang et al.

(10) Patent No.: US 7,927,142 B2
(45) Date of Patent: Apr. 19, 2011

(54) ELECTRICAL CONNECTOR HAVING A CURVED METAL SHELL FOR ANTI-MISMATING

(75) Inventors: Chen-Xi Wang, Kunshan (CN); Hong-Qiang Han, Kunshan (CN); Zi-Qiang Zhu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/625,565

(22) Filed: Nov. 25, 2009

(65) Prior Publication Data

US 2010/0130062 A1 May 27, 2010

(51) Int. Cl.
*H01R 13/648* (2006.01)

(52) U.S. Cl. ..... 439/607.04

(58) Field of Classification Search ..... 439/607.01, 439/607.04, 108, 101
See application file for complete search history.

(56) References Cited

U.S. PATENT DOCUMENTS

| | | | | |
|---|---|---|---|---|
| 5,938,473 | A | 8/1999 | Nishio et al. | |
| 6,793,531 | B1 * | 9/2004 | Zhang | 439/607.04 |
| 7,086,901 | B2 * | 8/2006 | Zhang | 439/607.56 |
| 2005/0048839 | A1 * | 3/2005 | Zhang | 439/607 |
| 2007/0149053 | A1 * | 6/2007 | Wan et al. | 439/607 |

* cited by examiner

*Primary Examiner* — Chandrika Prasad
(74) *Attorney, Agent, or Firm* — Wei Te Chung; Andrew C. Cheng; Ming Chieh Chang

(57) ABSTRACT

An electrical connector (100) includes an insulative housing (1), a number of contacts (2) retained in the insulative housing (1), and a metal shell (3) covering the insulative housing (1). The insulative housing (1) has a base (11) and a tongue (12) extending forwardly from the base (11). The metal shell (3) has a top wall (31), a bottom walls (32), and a pair of side walls (33). The top wall (31), bottom wall (32) and side walls (33) define a receiving space (34) therebetween. The bottom wall (32) has two first walls (321) extending opposed to each other from a lower end of the side walls (33), two oblique second walls (322) extending inwardly and upwardly from two first walls (321), and a third wall (323) connecting two second walls (322) together. The third wall (323) is higher than the second walls (322) along an up to down direction.

20 Claims, 5 Drawing Sheets

ELECTRICAL CONNECTOR HAVING A CURVED METAL SHELL FOR ANTI-MISMATING

BACKGROUND OF THE INVENTION

1. Field of the Invention

The present invention relates to an electrical connector, and more particularly to electrical connectors with improved anti-mismating mechanism.

2. Description of Related Art

Electrical connectors present as a medium being widely used in computers and other electronic device for electrically connecting the electronic device with each other to transmit signals. A common electrical connector usually includes an insulative housing, a plurality of contacts retained in the insulative housing for transmitting signals, and a metal shell covering the insulative housing for shielding the electrical connector from being disturbed.

Various electrical connectors are designed by electronic companies for being used in different or same electronic devices. Of course, there will be many similar electrical connectors being designed, which is easily mismatched by consumers. When different electrical connectors are mismatched with each other, the electronic devices will transmit unmatchable signals to each other, which is easily destroyed the electronic devices.

Hence, an improved electrical connector with an improved anti-mismating mechanism is desired to overcome the above problems.

BRIEF SUMMARY OF THE INVENTION

According to the present invention, an electrical connector comprises: an insulative housing having a base and a tongue extending forwardly from the base; a plurality of contacts retained in the insulative housing; and a metal shell covering the insulative housing, the metal shell having a pair of opposed top and bottom walls, and a pair of side walls connecting the top and bottom walls together, the top wall, bottom wall and side walls defining a receiving space therebetween; wherein the tongue extends into the receiving space, the bottom wall having two first walls extending opposed to each other from a lower end of the side walls, two oblique second walls extending inwardly and upwardly from two first walls, and a third wall connecting two second walls together, the third wall is higher than the second walls along an up to down direction.

According to another aspect of the present invention, an electrical connector comprises: a metal shell having a pair of opposed top and bottom walls, and a pair of opposed side walls connecting the top and bottom walls, the top wall, bottom wall and two side walls defines a receiving space for receiving a corresponding plug; an insulative housing retained in the receiving space, the insulative housing having a base and a tongue extending forwardly from the base; and a plurality of contacts retained in the insulative housing; wherein the metal shell having a pair of ridges extending outwardly from two sides of the bottom wall to form a protrusive third wall protruding toward the receiving space between the ridges.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
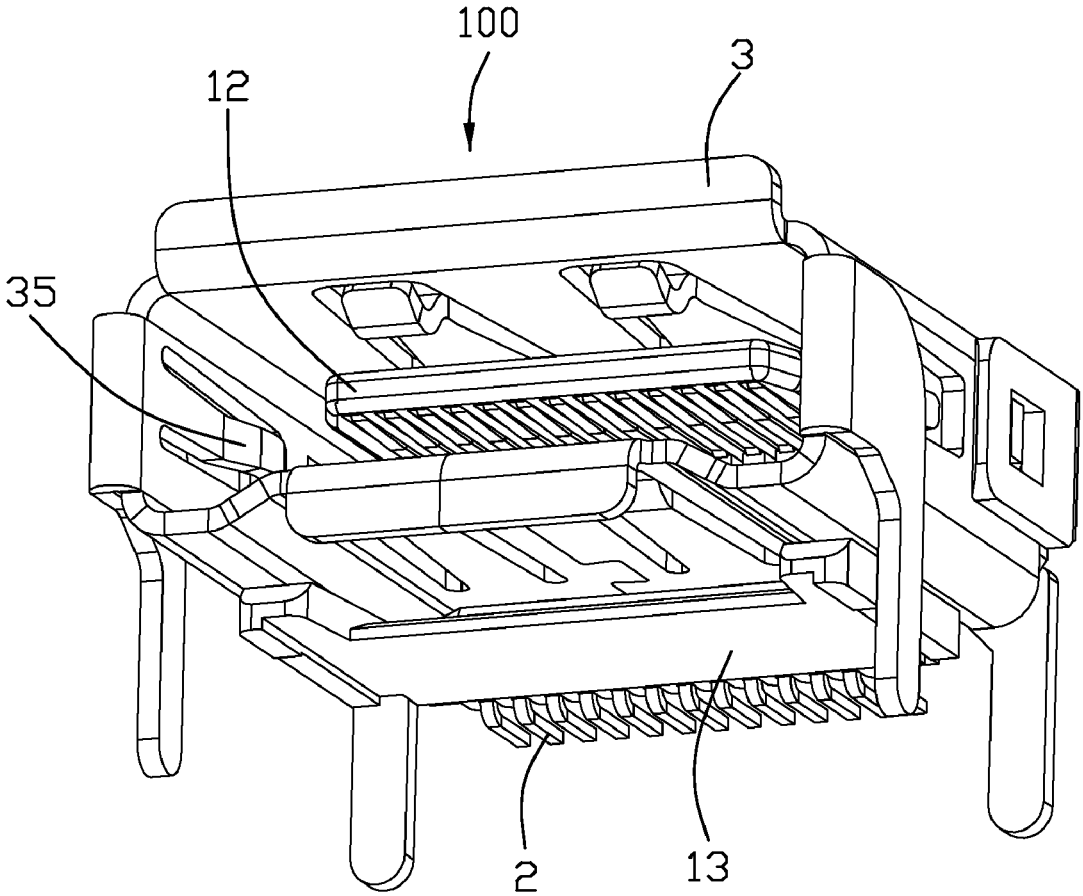
FIG. 1 is a perspective view of an electrical connector according to the present invention.
Figure 2:
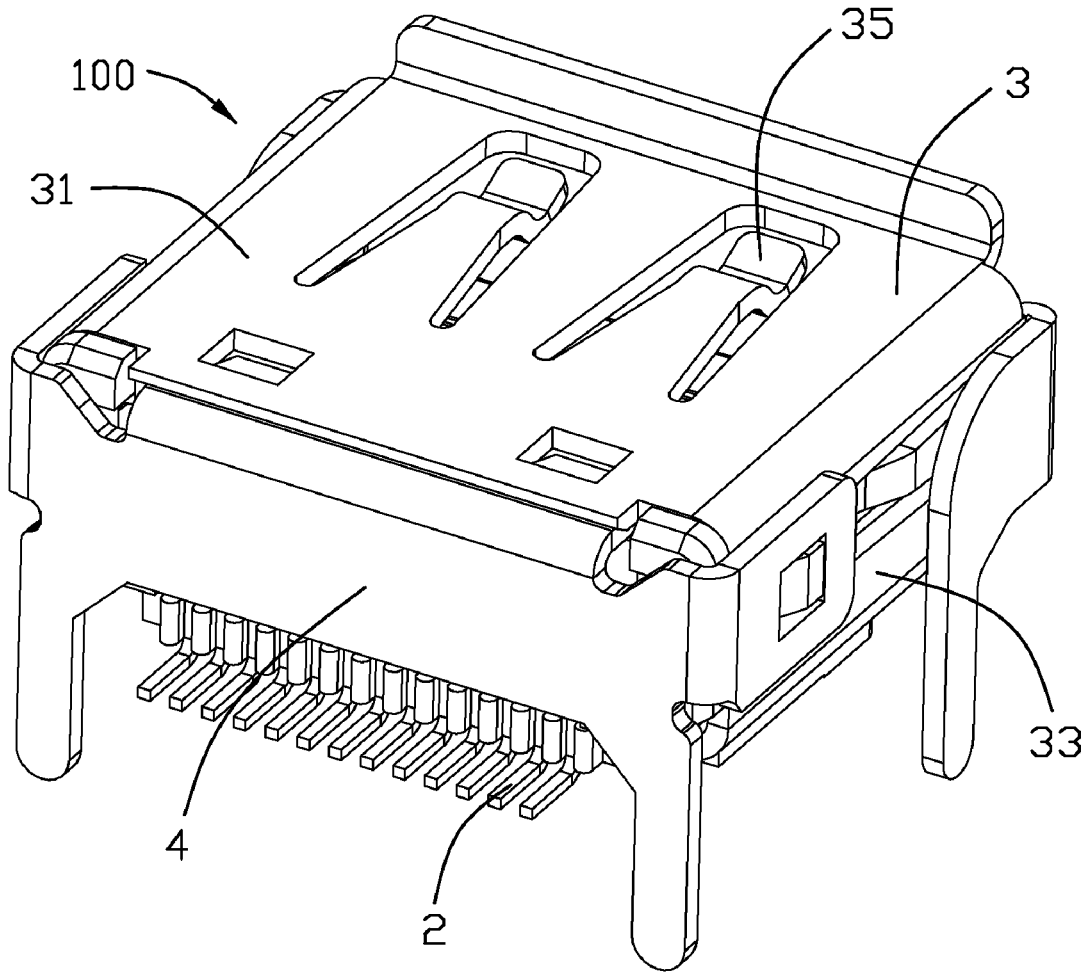
FIG. 2 is a view similar to FIG. 1, while taken from another aspect.
Figure 3:
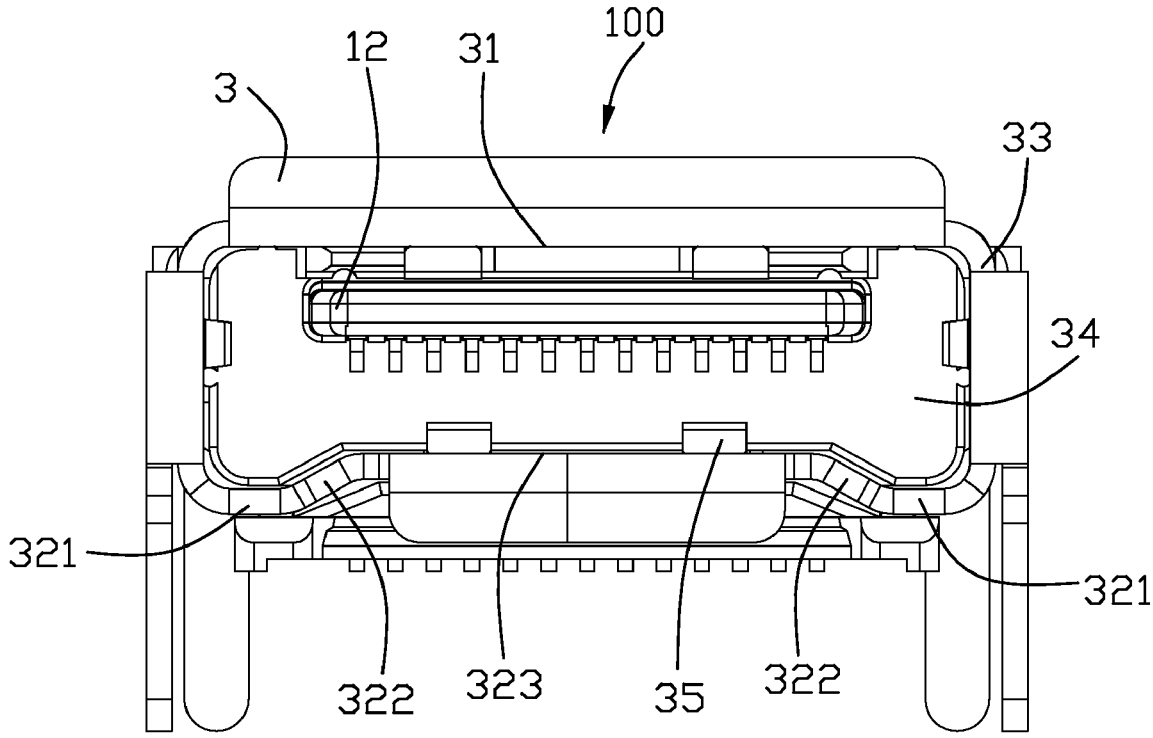
FIG. 3 is a front elevational view of the electrical connector shown in FIG. 1.
Figure 4:
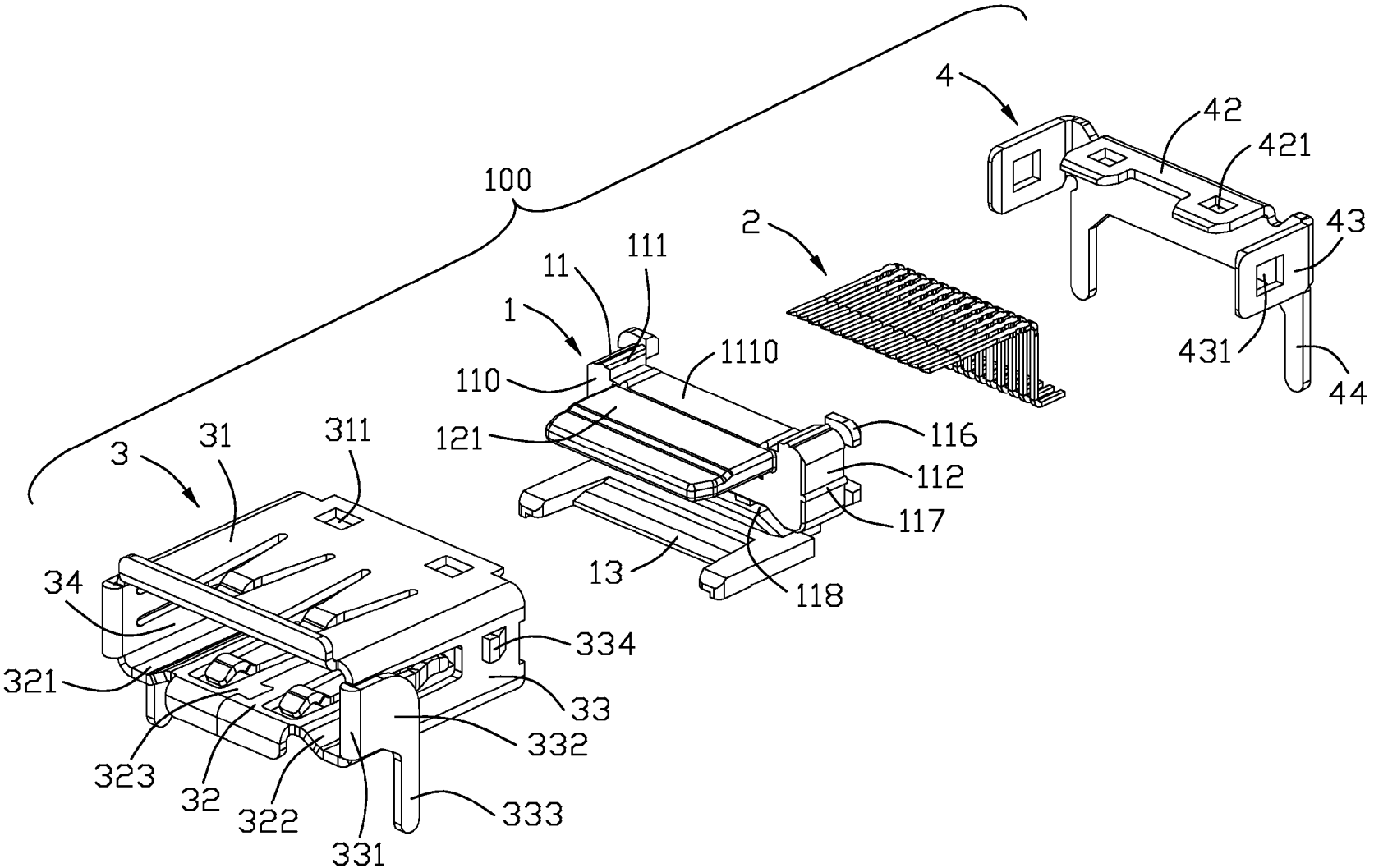
FIG. 4 is an exploded view of the electrical connector shown in FIG. 1.
Figure 5:
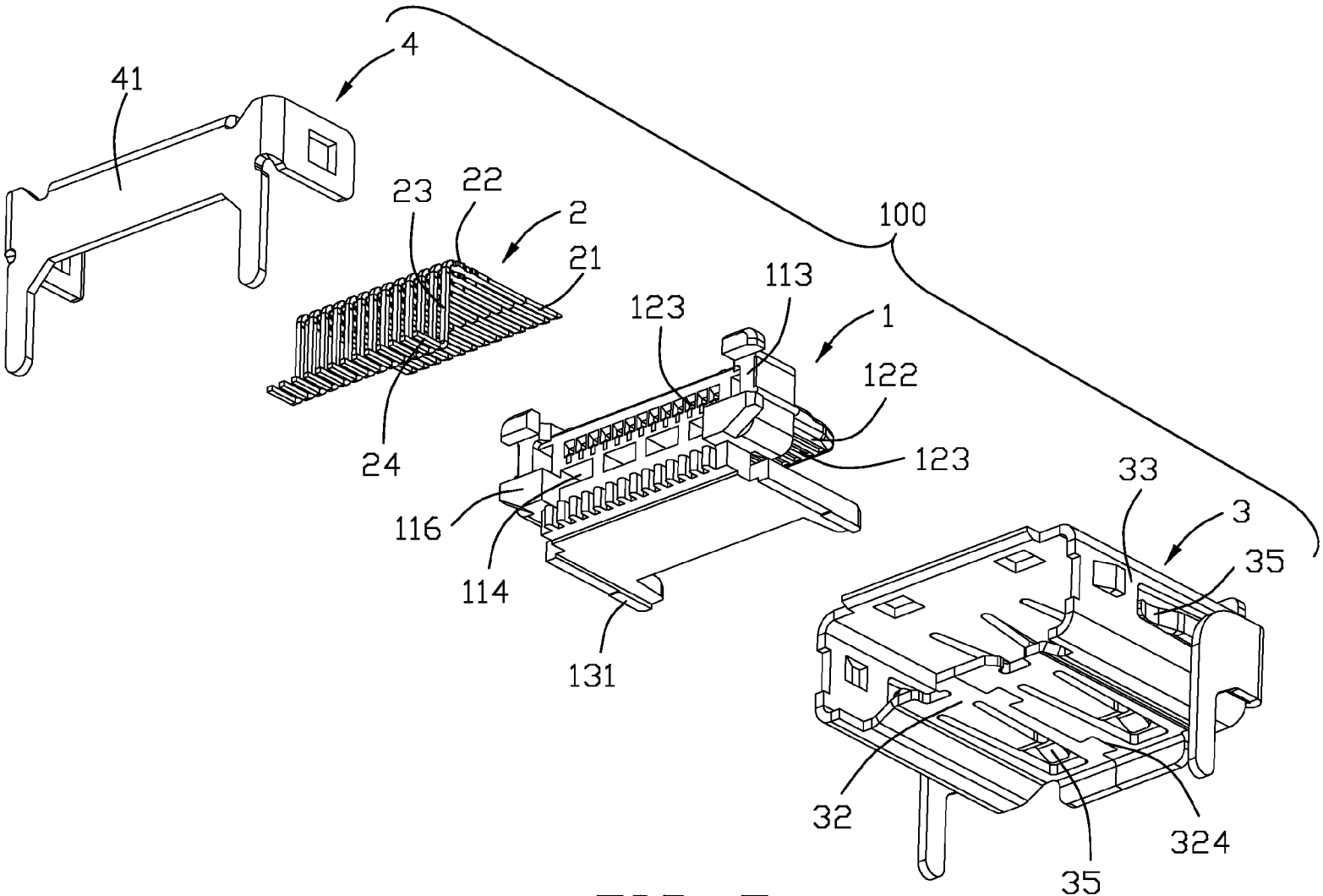
FIG. 5 is a view similar to FIG. 4, while taken from another aspect.

Referring to FIGS. 1-5, an electrical connector 100 according to the present invention is disclosed. The electrical connector 100 comprises an insulative housing 1, a plurality of contacts 2 retained in the insulative housing 1, a metal shell 3 and a rear cover 4 covering the insulative housing 1.

The insulative housing 1 has a base 11. The base 11 has a pair of opposite front face 110 and rear face 113, a top face 111 and a pair of side faces 112. The insulative housing has a tongue 12 extending forwardly from the front face 110. The tongue 12 has a pair of opposite upper surface 121 and lower surface 122. The insulative housing 1 defines a depression portion 1110 recessed from a middle position of the top face 111 to retain the rear cover 4. The depression portion 1110 has a bottom face which is approximately located at a same plane with the upper surface 121 of the tongue 12 for decreasing a height of the insulative housing 1. The base 11 has a plurality of protrusions 117 protruding from the top face 111, side faces 112 and bottom face of the depression portion 1110 to engage with the metal shell 3 and rear cover 4. The tongue 12 defines a plurality of passageways 123 recessed from the lower surface 122 thereof and extending through the insulative housing 1 along a front to back direction. The base 11 has four projections 116 extending outwardly from four corners of the rear face 113 for preventing the metal shell 3 from moving backwardly.

The insulative housing 1 has an accessorial board 13 extending forwardly from bottom of the base 11. The accessorial board 13 is spaced apart from the tongue 12 along an up to down direction and parallel to the tongue 12. When the metal shell 3 is assembled to the insulative housing 1, the accessorial board 13 is located below the metal shell 3 for supporting and strengthening the metal shell 3. The accessorial board 13 has a pair of blocks 131 extending along the front to back direction for decreasing a contact area between the electrical connector 100 and a circuit board (not shown), and decreasing a manufacture precision of the insulative housing 1. The insulative housing 1 defines a slot 118 between the base 11 and the accessorial board 13. The slot 118 extends along a transverse direction to fasten a rear end of the metal shell 2. The base 11 defines a plurality of holes 114 at a rear side thereof for fleeing material.

The contacts 2 comprise five grounding contacts and four pairs of differential signal contacts alternatively arranged between the grounding contacts. There are three pairs of differential signal contacts transmitting audio and video signals, and a pair of differential signal contacts arranged at one side of said three pairs of differential signal contacts and bi-directionally transmitting data signals for connecting different electronic device easily. The differential signal contacts and the grounding contacts are arranged in a row in the transverse direction. The electrical connector 100 has four pairs of said differential signal contacts which supply a wider transmission bandwidth and increase signal transmission speed.

Each contact has a contact portion 21 extending to the tongue 12, a securing portion 22 retained in the passageways 123 of the base 11, a connection portion 23 bending downwardly from a rear end of the securing portion 22, and a tail portion 24 extending backwardly for soldering to the circuit board. The contact portions 21 of the differential signal contacts and grounding contacts are arranged in a row and alternatively received in the passageways 123 of the tongue 12 for connecting with a corresponding plug (not shown). The tail portions 24 of all contacts 2 extend out of the insulative housing 1 and are parallel to the contact portions 21. Of course, the tail portions 24 can be arranged to perpendicular or oblique to the contact portions 21 according to consumer's requirement. The holes 114 are arranged at a front side of the connection portions 23 when the contacts 2 are assembled to the insulative housing 1 for decreasing contact area between the contacts 2 and the insulative housing 1, which can decrease impedance of the contacts 2 and increase transmission speed. The tail portions 24 and the blocks 131 are arranged in a same plane for easily controlling coplanarity of tail portions 24.

The metal shell 3 is made of a piece of metal sheet, and comprises a pair of opposed top and bottom walls 31, 32, and a pair of side walls 3 connecting the top and bottom walls 31, 32. The top wall 31, bottom wall 32 and side walls 33 defines a receiving space 34 therebetween for receiving the corresponding plug. The tongue 12 is received in the receiving space 34.

The bottom wall 32 has a pair of first wall 321 extending opposed to each other from a lower end of side walls 33, a pair of oblique second walls 322 extending inwardly and upwardly from two first walls 321, and a third wall 323 located between two second walls 322 and connecting inner ends of two second walls 322 together. The third wall 323 is located at an upper position of the second wall 322 and protrudes toward the receiving space 34. The third wall 323 is formed with a joined portion 324 when the metal sheet is bended together. The first walls 321 are parallel to the top wall 3 and have same width along the transverse direction. The third wall 323 is parallel to the top wall 31 and the first walls 321, and forms an isosceles trapezoid with two second walls 322. It is to see that the bottom wall 32 is designed to include five alternative walls which present as an anti-mismating mechanism to prevent an unmatchable plug from being inserted into the receiving space 34 at a front end; besides, the second walls 322 extend obliquely from the first walls 321 to form two ridges protruding outwardly and located at two sides of the bottom walls 32. The ridges extend along the front to back direction to form a pair of grooves extending through the metal shell 3. The grooves are formed between the side walls 33, first walls 321 and second walls 322 respectively and located at two lateral sides of the third wall 323 along the transverse direction. The grooves are a part of the receiving space 34 and located below the third wall 323 along the up to down direction. Therefore, the third wall 323 protrudes toward the receiving space 34 which can strengthen the third wall 323 and form a good anti-mismating mechanism to prevent the unmatchable plug from being inserted into the receiving space 34. In addition, a front end of the tongue 12 defines a width which is approximately same to that of the third wall 323 along the transverse direction. The first walls 321 and second walls 322 each defines a width along the transverse direction, and the width is smaller than that of the third wall 323.

The top wall 31 and third wall 323 each has a pair of spring arms 35 extending into the receiving space 34. The side walls 32 each has a sparing arm 35 extending into the receiving space 34. The spring arms 35 of the third wall 323 are strengthened when the third wall 323 protrudes toward the receiving space 34. The lower surface 122 of the tongue 12 and the third wall 323 define a distance therebetween, and the distance is at least double of distance between the upper surface 121 and the top wall 31. The distance between the upper surface 121 and the top wall 31 can just receive a top wall of shell on the corresponding plug for preventing the unmatchable plug from being inserted therein.

The side wall 33 has a bending portion 331 bending outwardly from a front end thereof, a plate portion 232 extending backwardly from a free end of the bending portion 331, and a first mounting leg 333 vertically extending downwardly from the plate portion 232. The first mounting leg 333 can be cut and directly bended from the metal sheet which is easily to be manufactured. Of course, the first mounting leg 333 can be directly stamped from the side walls 33. The plate portion 232 and first mounding legs 333 are parallel to the side walls 33. The top wall 31 defines a pair of openings 311 behind the spring arms 35 thereof. The side walls 33 each has a locking tang 334 at a rear side thereof. The top wall 31, the side walls 33 and bottom wall 32 connect with each other and have four connections therebetween. The four connections resist the four projections 116 for ensuring a rear side of the metal shell 3 having a better power distribution, thereby the metal shell 3 can not be easily distort and the joined portion 324 ban not be easily split.

The rear cover 4 is made of another piece of metal sheet, and comprises a body portion 41 covering a rear side of the insulative housing 1, a fastening strip 42 bending forwardly from a top end of the body portion 41, a pair of latch strips 43 bending forwardly from two sides of the body portion 41, and a pair of second mounting legs 44 extending downwardly from a lower end of the body portion 41. The fastening strip 42 is sandwiched in the depression portion 1110 and engages with the protrusions 117 for preventing the rear cover 4 moving along the transverse direction. The fastening strip 42 has a pair of bards 421 extending upwardly to lock with the openings 311. The latch strips 43 each defines a locking hole 431 to lock with the locking tangs 334 of the side walls 33 for preventing the rear cover 4 from moving backwardly. The second mounting legs 44 are located at a same plane with the body portion 41 for being manufactured easily. Besides, the first mounting legs 333 are spaced apart from the second mounting legs 44 along the front to back direction, and the first mounting legs 333 are perpendicular to the second mounting legs 44 for stably mounting the electrical connector 100 of the present invention to the circuit board.

As fully described above, the electrical connector 100 can be effectively prevented the unmatchable plug from being inserted therein via anti-mismating mechanisms formed by five alternative walls 321, 322, 323 of the bottom wall 32, or the distance between the top wall 31, bottom wall 32 of the metal shell 3 and the tongue 12, therefore the electrical connector 100 of the present invention is conveniently to be used.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulative housing having a base and a tongue extending forwardly from the base;

a plurality of contacts retained in the insulative housing; and a metal shell covering the insulative housing, the metal shell having a pair of opposed top and bottom walls, and a pair of side walls connecting the top and bottom walls together, the top wall, bottom wall and side walls defining a receiving space therebetween;

wherein the tongue extends into the receiving space, the bottom wall having two first walls extending opposed to each other from a lower end of the side walls, two oblique second walls extending inwardly and upwardly from two first walls, and a third wall connecting two second walls together, the third wall is higher than the second walls along an up to down direction;

wherein a front end of the tongue defines a width which is approximately same to that of the third wall along a transverse direction of the insulative housing, the first walls and second walls each defines a width which is smaller than that of the third wall;

wherein the third wall has a pair of spring arms extending into the receiving space.

2. The electrical connector according to claim 1, wherein the first walls are parallel to the top wall and have same width along a transverse direction of the insulative housing.

3. The electrical connector according to claim 1, wherein the third wall is parallel to the top wall and forms an isosceles trapezoid with two second walls.

4. The electrical connector according to claim 1, wherein the tongue has an upper surface and a lower surface, the lower surface and the third wall define a distance therebetween, and the distance is at least double of distance defined between the upper surface and the top wall.

5. The electrical connector according to claim 4, wherein each contact has a contact portion extending to the tongue and a tail portion extending out of the insulative housing, the contact portions of all contacts are arranged on the lower surface of the tongue.

6. The electrical connector according to claim 5, wherein the contacts comprise four pairs of differential signal contacts wherein three pairs thereof transmit audio and video signals and the rest a pair thereof bi-directionally transmit data signals.

7. The electrical connector according to claim 4, wherein the insulative housing has a top wall and a pair of side walls, the top wall defines a depression portion recessed from a middle position thereof, the depression portion has a bottom face which is located at a same plane with the upper surface of the tongue, the electrical connector further comprises a rear cover covering a rear side thereof, and the rear cover has a fastening strip bending forwardly and being sandwiched in the depression portion.

8. The electrical connector according to claim 7, wherein the fastening strip has a pair of barbs extending upwardly, the top wall of the metal shell defines a pair of openings to lock with the barbs.

9. The electrical connector as claimed in claim 1, wherein the third wall is equipped with a curved flange on a front edge thereof while said two first walls are not.

10. An electrical connector comprising:

a metal shell having a pair of opposed top and bottom walls, and a pair of opposed side walls connecting the top and bottom walls, the top wall, bottom wall and two side walls defines a receiving space for receiving a corresponding plug;

an insulative housing retained in the receiving space, the insulative housing having a base and a tongue extending forwardly from the base; and a plurality of contacts retained in the insulative housing;

wherein the metal shell having a pair of ridges extending outwardly from two sides of the bottom wall to form a protrusive third wall protruding toward the receiving space between the ridges;

wherein the third wall has a pair of spring arms extending into the receiving space;

wherein the insulative housing has an accessorial board extending forwardly from a lower side of the base and spaced apart from the tongue along an up to down direction, and the accessorial board has a pair of posts upwardly supporting the ridges and a middle portion spaced apart from the third wall along the up to down direction for supplying a deformation space between the third wall and the middle portion to the spring arms.

11. The electrical connector according to claim 10, wherein the ridges extend along a front to back direction of the metal shell to form a pair of grooves extending through the metal shell, the grooves are a part of the receiving space and located at two lateral sides of the third wall along a transverse direction and below the third wall along an up to down direction.

12. The electrical connector according to claim 10, wherein a front end of the tongue defines a width which is approximately same to that of the third wall along a transverse direction of the insulative housing.

13. The electrical connector according to claim 10, wherein the contacts comprise four pairs of differential signal contacts wherein three pairs thereof transmit audio and video signals and the rest a pair thereof is located at one side of said three pairs of differential signal contacts and bi-directionally transmit data signals, and five grounding contacts respectively arranged at two sides of each pair of differential signal contacts, the differential signal contacts and the grounding contacts are arranged in a row and each has a contact portion extending to a lower surface of the tongue.

14. The electrical connector as claimed in claim 10, wherein the posts extend along a front to back direction and forwardly extend beyond a front end of the middle portion.

15. The electrical connector as claimed in claim 10, wherein the insulative housing has a top wall and a pair of side walls, the top wall defines a depression portion recessed from a middle position thereof, the depression portion has a bottom face which is located at a same plane with the upper surface of the tongue, the electrical connector further comprises a rear cover covering a rear side thereof, and the rear cover has a fastening strip bending forwardly and being sandwiched in the depression portion, and the fastening strip has a pair of barbs extending upwardly, the top wall of the metal shell defines a pair of openings to lock with the barbs.

16. An electrical connector comprising:

an insulative housing defining a mating tongue extending in a front-to-back direction with a contacting face thereon in a horizontal plane;

a plurality of contacts disposed in the housing with contacting sections exposed upon the contacting face; and a metallic shell enclosing said housing and defining a mating port receiving said mating tongue therein, said shell including opposite first and second walls both extending parallel to said contacting face, and opposite third and fourth walls located between said opposite first and second walls in a vertical direction perpendicular to said horizontal plane, said first, second, third and fourth walls commonly surrounding said mating port; wherein the second wall includes two opposite side sections with a horizontal middle section therebewteen along a transverse direction perpendicular to both said front-to-back direction and said vertical direction under condition that said two opposite side sections are respectively joined with the corresponding third and fourth walls, and the middle section is located closer to the first wall than the two opposite side sections in said vertical direction;

wherein said horizontal middle section is equipped with a curved flange on a front edge thereof while said two opposite side sections are not.

17. The electrical connector as claimed in claim 16, wherein each of said side sections defines an outer horizontal portion joined with the corresponding one of said third and fourth walls, and an inner oblique portion linked between said outer horizontal portion and the horizontal middle section.

18. The electrical connector as claimed in claim 16, wherein said horizontal middle section is equipped with a pair of spring arms extending into the mating port toward the first wall.

19. The electrical connector as claimed in claim 16, wherein the insulative housing has a top wall and a pair of side walls, the top wall defines a depression portion recessed from a middle position thereof, the depression portion has a bottom face which is located at a same plane with the upper surface of the tongue, the electrical connector further comprises a rear cover covering a rear side thereof, and the rear cover has a fastening strip bending forwardly and being sandwiched in the depression portion, and the fastening strip has a pair of barbs extending upwardly, the first wall of the metallic shell defines a pair of openings to lock with the barbs.

20. The electrical connector as claimed in claim 18, wherein each of said side sections including an outer horizontal segment linked to the corresponding one of the third and the fourth walls, and an inner oblique wall linked to the horizontal middle section under condition that a dimension of the outer horizontal segment is similar to that of the inner oblique segment along the transverse direction.

* * * * *